United States Patent [19]

Dumortier

[11] Patent Number: 4,546,720

[45] Date of Patent: Oct. 15, 1985

[54] CONNECTING DEVICE BETWEEN THE WISHBONE AND THE MAST OF A SAILBOARD

[75] Inventor: Thierry M. Dumortier, Hermee, Belgium

[73] Assignee: Fabrique Nationale Herstal, Herstal, Belgium

[21] Appl. No.: 528,177

[22] Filed: Aug. 31, 1983

[30] Foreign Application Priority Data

Sep. 6, 1982 [BE] Belgium ..... 2/59818

[51] Int. Cl.[4] ..... B63B 15/00

[52] U.S. Cl. ..... 114/98; 114/39

[58] Field of Search ..... 114/39, 39.2, 97, 98

[56] References Cited

FOREIGN PATENT DOCUMENTS

| | | | |
|---|---|---|---|
| 2816584 | 10/1979 | Fed. Rep. of Germany | 114/98 |
| 2912868 | 10/1980 | Fed. Rep. of Germany | 114/98 |
| 3100624 | 8/1982 | Fed. Rep. of Germany | 114/98 |
| 2423391 | 11/1979 | France | 114/98 |
| 8204425 | 12/1982 | Int'l Prop. Org. | 114/98 |

*Primary Examiner*—Jesûs D. Sotelo

*Attorney, Agent, or Firm*—Schwartz, Jeffery, Schwaab, Mack, Blumenthal & Evans

[57] ABSTRACT

The present invention relates to a connecting device between the wishbone 7 and the mast 2 of a sailboard, characterized in that it comprises a substantially V-shaped element 8 pivoted on each of both arms of the wishbone 7 and intended to surround the mast 2 when hoisting home the clew 6 of the sail 4 on the said wishbone 7.

3 Claims, 4 Drawing Figures

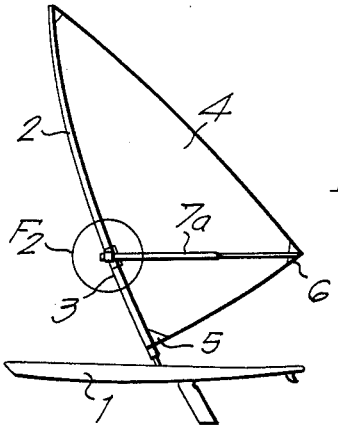
Fig. 1
Fig. 2
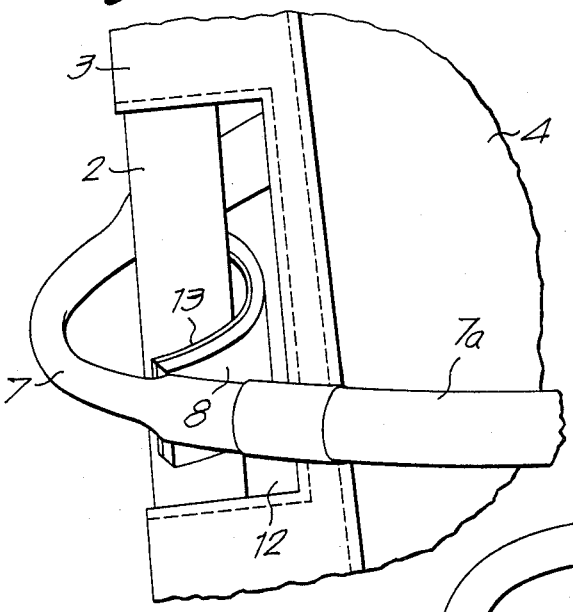
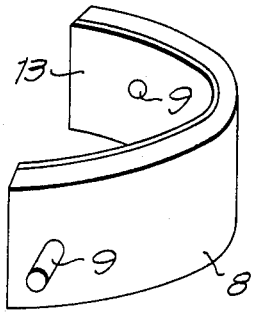
Fig. 3
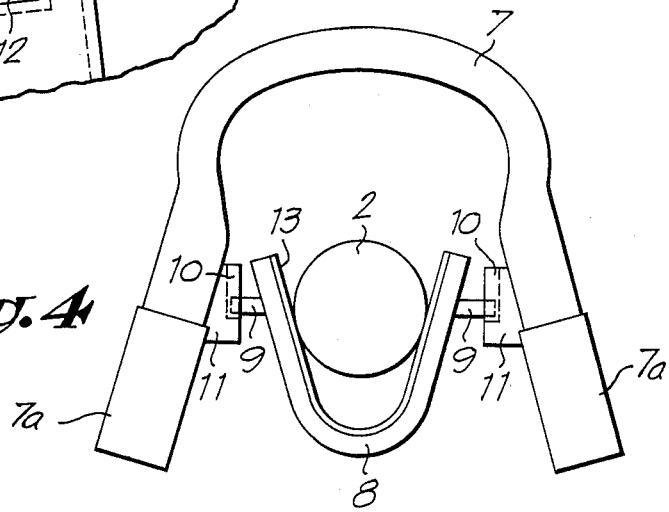
Fig. 4

CONNECTING DEVICE BETWEEN THE WISHBONE AND THE MAST OF A SAILBOARD

The present invention relates to a connecting device for connecting the wishbone and the mast of a sailboard.

Generally, the head of the wishbone is secured to the mast by means of a rope. One end of the latter is secured to the mast through a capstan knot followed by two dead turns and a lacing through one or several holes provided therefor in the head of the wishbone.

Then, the other end of the said rope is either engaged on a lug or secured in a wedging means carried on one arm of the wishbone.

This conventional securing method makes it difficult to adjust the height of wishbone on the most, said adjustment being necessary in consideration of the height of the user as well as the conditions of the wind.

The object of the present invention is to solve this problem. For this purpose, a connecting device connecting the wishbone and the mast of a sailboard according to the invention comprises a substantially V-shaped element, pivotably connected to both arms of the wishbone surrounds the mast when hoisting home the clew of the sail on the wishbone.

For more clearness, an embodiment of the invention will be described hereafter by way of example, reference being made to the enclosed drawings in which:

FIG. 1 shows diagrammatically a sailboard and it is intended to locate the device according to the invention;

FIG. 2 is a perspective view, on an enlarged scale, showing the portion indicated in circle F2 in FIG. 1;

FIG. 3 is a perspective view of the V-shaped connecting part forming the main element of the invention; and FIG. 4 is a plan view of the device shown in FIG. 2.

The sailboard shown in FIG. 1 comprises a float 1 which is made removably integral with a hinged mast 2 about which is engaged the case 3 of a sail 4. The tack point 5 of the sail 4 is hoisted home on the foot of the mast 2, whereas the clew 6 thereof is hoisted home on one end of a wishbone 7 the other ends of which are pivotably connected to the mast 2.

According to the invention, the connection between the wishbone 7 and the mast 2 is obtained through the intermediary of a substantially V-shaped element 8, provided with two side studs 9. Each of the studs 9 are intended to be engaged in slots 10 provided therefor in a block 11, each of said blocks each being each integral with one arm of the wishbone 7.

The element 8, engaged through the conventional roach 12 of the sail 4, is provided to surround the mast when the clew 6 is hoisted home on the wishbone 7. Owing to this hoisting home, the studs 9 are prevented from leaving the slots 10.

It is to be noted that the height of the element 8 on the mast 2 may be readily modified as a function of the height of the pilot and/or the conditions of the wind.

As seen in FIGS. 1, 2 and 4, a pair of side booms 7*a* are connected to the wishbone 7, and the side booms 7*a* and wishbone 7 are pivotable in a vertical direction relative to the the V-shaped element 8.

The element 8 may be advantageously provided with a protecting cover 13, e.g. of synthetic rubber, teflon or similar.

I claim:

1. A connecting device for connecting a wishbone having two arms with the mast of a sailboard or the like, and having a pair of side booms connected to the wishbone, comprising: a substantially V-shaped element pivotally connected by means of a pivotal connection to each arm of the wishbone and arranged to engage the mast when hoisting home the clew of the sail on the wishbone; said pivotal connection including each of the arms of the wishbone having a block with a slot therein, and the V-shaped element having projection means thereon engaging the slots, whereby the side booms and wishbone are pivotable in a vertical direction relative to the V-shaped element.

2. A connecting device according to claim 1, wherein the surfaces of said V-shaped element which engage the mast are provided with a protective coating.

3. A connecting device according to claim 2, wherein the protective coating comprises a layer of synthetic rubber.

* * * * *